US011136224B2

(12) United States Patent
Nishioka et al.

(10) Patent No.: US 11,136,224 B2
(45) Date of Patent: Oct. 5, 2021

(54) LIFTING BEAM AND METHOD FOR LIFTING OBJECT SUSPENDED VERTICALLY FROM LIFTING BEAM

(71) Applicant: Mitsubishi Hitachi Power Systems, Ltd., Yokohama (JP)

(72) Inventors: Yasunori Nishioka, Yokohama (JP); Shinya Hashimoto, Yokohama (JP); Takuro Kameda, Yokohama (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 0 days.

(21) Appl. No.: 16/630,171

(22) PCT Filed: Sep. 20, 2018

(86) PCT No.: PCT/JP2018/034714
§ 371 (c)(1),
(2) Date: Jan. 10, 2020

(87) PCT Pub. No.: WO2019/069691
PCT Pub. Date: Apr. 11, 2019

(65) Prior Publication Data

US 2020/0231413 A1 Jul. 23, 2020

(30) Foreign Application Priority Data

Oct. 2, 2017 (JP) ..... JP2017-192949

(51) Int. Cl.
*B66C 1/10* (2006.01)

(52) U.S. Cl.
CPC ..... *B66C 1/10* (2013.01)

(58) Field of Classification Search
CPC .. B66C 1/10; B66C 1/108; B66C 1/66; B66C 1/22

(Continued)

(56) References Cited

U.S. PATENT DOCUMENTS 2,329,008 A * 9/1943 Smith ..... B66C 1/10 294/67.5
2,905,501 A * 9/1959 Jakubowski ..... B66C 1/10 294/81.3

(Continued)

FOREIGN PATENT DOCUMENTS

JP 43-25107 10/1968
JP 60-133883 9/1985

(Continued)

OTHER PUBLICATIONS

Office Action dated Jul. 7, 2020 in corresponding Japanese Patent Application No. 2017-192949, with English Translation.

(Continued)

*Primary Examiner* — Paul T Chin
(74) *Attorney, Agent, or Firm* — Wenderoth, Lind & Ponack, L.L.P.

(57) ABSTRACT

A lifting beam for suspending an object to be lifted in a vertical direction has a lower end surface extending in a longitudinal direction of the lifting beam on a vertical lower side in a state where the object is suspended. The lower end surface includes a first lower end portion, a second lower end portion positioned away from the first lower end portion to a first side in the longitudinal direction, and a third lower end portion positioned away from the first lower end portion to a second side in the longitudinal direction, on the opposite side of the first lower end portion from the second lower end portion. The second lower end portion is positioned higher than the first lower end portion, and the third lower end portion is positioned lower than the second lower end portion when the object is suspended from the lifting beam.

11 Claims, 8 Drawing Sheets

(58) Field of Classification Search
USPC ..... 294/81.1, 81.3, 81.5, 67.1, 67.5
See application file for complete search history.

(56) References Cited

U.S. PATENT DOCUMENTS 3,478,906 A * 11/1969 Smith ..... B66C 1/10 414/411
3,547,478 A * 12/1970 Pradon ..... B66C 1/663 294/81.21
3,603,635 A * 9/1971 Ide ..... B66C 1/10 294/67.1
3,995,903 A * 12/1976 Ernst ..... B66C 1/10 294/81.3
4,114,765 A * 9/1978 Kojima ..... B66C 1/12 269/46
4,373,755 A * 2/1983 Herberholz ..... B66C 1/10 294/81.3
4,462,627 A * 7/1984 Kudlicka ..... B66C 1/22 294/81.2
4,516,801 A * 5/1985 Burd ..... B66C 1/66 294/67.1
7,708,325 B2 * 5/2010 Grant ..... B66C 13/08 294/81.4
2010/0176613 A1 * 7/2010 Huecker ..... B66C 1/10 294/67.5
2015/0023790 A1 * 1/2015 Friis ..... B66C 1/108 415/213.1

FOREIGN PATENT DOCUMENTS

JP 62-249891 10/1987
JP 06-025276 4/1994
JP 09-227069 9/1997
JP 3163967 11/2010

OTHER PUBLICATIONS

International Search Report dated Dec. 11, 2018 in International (PCT) Application No. PCT/JP2018/034714 with English Translation.
International Preliminary Report on Patentability and Written Opinion of the International Searching Authority dated Apr. 16, 2020 in International (PCT) Application No. PCT/JP2018/034714 with English Translation.

* cited by examiner

LIFTING BEAM AND METHOD FOR LIFTING OBJECT SUSPENDED VERTICALLY FROM LIFTING BEAM

TECHNICAL FIELD

The present disclosure relates to a lifting beam and a method for lifting an object suspended from the lifting beam in a vertical direction.

BACKGROUND ART

An elongated material is generally lifted by suspending the elongated material from a lifting beam and lifting the lifting beam by a crane. Patent Document 1 discloses a device for lifting a transmission.

CITATION LIST

Patent Literature

Patent Document 1: JPS62-249891A

SUMMARY

Problems to be Solved

As disclosed in Patent Document 1, generally, a conventional lifting beam has a uniform linear shape in the longitudinal direction. When an object to be lifted has a locally high-height portion in the longitudinal direction, since a lifting beam suspending the object is positioned higher than the highest portion of the outer surface of the object, if the object is suspended from the lifting beam having a uniform linear shape in the longitudinal direction, the total lifting height is increased. When the total lifting height is increased, the lifting cost is increased.

In view of the above circumstances, an object of at least one embodiment of the present invention is to provide a lifting beam that can reduce the lifting cost, and a method for lifting an object suspended vertically from the lifting beam.

Solution to the Problems (1) A lifting beam according to at least one embodiment of the present invention for suspending an object to be lifted in a vertical direction has a lower end surface extending in a longitudinal direction of the lifting beam and positioned on a vertical lower side in a state where the object is suspended. The lower end surface includes: a first lower end portion; a second lower end portion positioned away from the first lower end portion to a first side in the longitudinal direction; and a third lower end portion positioned away from the first lower end portion to a second side in the longitudinal direction, on an opposite side of the first lower end portion from the second lower end portion. The second lower end portion is positioned higher than the first lower end portion, and the third lower end portion is positioned lower than the second lower end portion, in a state where the object is suspended from the lifting beam.

With the above configuration (1), by suspending the largest-diameter portion of the object having a locally high-height portion in the longitudinal direction in the vicinity of the second lower end portion, the object can be suspended from the lifting beam while bringing the lifting beam as close to the object as possible, i.e., the suspension point can be lowered. Thus, it is possible to reduce the total lifting height, and consequently, it is possible to reduce the lifting cost.

(2) In some embodiments, in the above configuration (1), the lifting beam has an upper end surface extending in the longitudinal direction of the lifting beam and positioned on a vertical upper side in a state where the object is suspended, and the upper end surface includes: a first upper end portion located in the same position as the first lower end portion in the longitudinal direction; and a second upper end portion located in the same position as the second lower portion in the longitudinal direction. The first upper end portion is positioned lower than the second upper end portion in the vertical direction.

With the above configuration (2), it is possible to achieve the same effect as the above (1).

(3) In some embodiments, in the above configuration (1) or (2), the second lower end portion is located in the same position as a first support point for suspending and supporting the object in the longitudinal direction, and the third lower end portion is located in the same position as a second support point for suspending and supporting the object in the longitudinal direction.

With the above configuration (3), it is possible to achieve the same effect as the above (1).

(4) In some embodiments, in any one of the above configurations (1) to (3), the first lower end portion is positioned lower than the third lower end portion.

With the above configuration (4), since the object having a locally high-height portion in the longitudinal direction and recessed between both ends can be suspended from the lifting beam while bringing the lifting beam as close to the object as possible, i.e., the suspension point can be lowered, it is possible to reduce the total lifting height, and consequently, it is possible to reduce the lifting cost.

(5) In some embodiments, in any one of the above configurations (1) to (4), the first lower end portion is positioned such that a moment of a first-side portion of the lifting beam is equilibrated by a moment of a second-side portion of the lifting beam when the lifting beam is divided into the first-side portion including the second lower end portion and the second-side portion including the third lower end portion by a reference plane passing through a center of gravity of the lifting beam and the first lower end portion and perpendicular to the longitudinal direction.

With the above configuration (5), it is possible to lift the lifting beam that does not suspend the object while preventing rotation of the lifting beam.

(6) In some embodiments, in the above configuration (5), the lifting beam has a first tapered portion disposed between the first lower end portion and the second lower end portion and decreasing in height from the first lower end portion toward the second lower end portion; and a second tapered portion disposed between the first lower end portion and the third lower end portion and decreasing in height from the first lower end portion toward the third lower end portion.

With the above configuration (6), it is possible to reduce the weight of the lifting beam while ensuring the strength to withstand the moment due to suspension of the object, compared to the lifting beam having a constant height in the longitudinal direction. Since a larger lifting weight requires a larger crane and thus a higher cost, it is possible to reduce the lifting cost by reducing the weight of the lifting beam.

(7) In some embodiments, in the above configuration (6), the lifting beam has a first support portion extending from an end of the first tapered portion along the longitudinal direction and having a lower end surface including the second lower end portion; and a second support portion extending from an end of the second tapered portion along the longitudinal direction and having a lower end surface including the third lower end portion, and at least one of a first support point and a second support point for suspending and supporting the object is adjustable in position in the longitudinal direction.

With the above configuration (7), it is possible to easily adjust the suspended position when the object is suspended from the lifting beam.

(8) In some embodiments, in the above configuration (7), the lifting beam has an upper end surface extending in the longitudinal direction of the lifting beam and positioned on a vertical upper side in a state where the object is suspended, and at least one of a position adjustment member for adjusting a suspended position of the object at the first support point or a position adjustment member for adjusting a suspended position of the object at the second support point is arrangeable on the upper end surface.

With the above configuration (8), by arranging at least one of the two position adjustment members on the upper end surface of the lifting beam, the object can be brought further close to the object, i.e., the suspension point can be further lowered. Thus, it is possible to further reduce the total lifting height, and consequently, it is possible to further reduce the lifting cost.

(9) A method for lifting an object to be lifted suspended from a lifting beam in a vertical direction according to at least one embodiment of the present invention is a method for lifting an object suspended in the vertical direction from a lifting beam having a lower end surface extending along a longitudinal direction of the lifting beam and positioned on a vertical lower side in a state where the object is suspended, and comprises a connection step of connecting the object to the lifting beam via a string member. In the connection step, only a portion of the lower end surface is positioned lower than the highest portion of an outer surface of the object.

With the above configuration (9), since only a portion of the lower end surface is positioned lower than the highest portion of the outer surface of the object, the object can be suspended from the lifting beam while bringing the lifting beam as close to the object as possible, i.e., the suspension point can be lowered. Thus, it is possible to reduce the total lifting height compared to the lifting beam having a constant height in the longitudinal direction, and consequently, it is possible to reduce the lifting cost.

(10) In some embodiments, the above method (9) further comprises, before the connection step, a step of lowering the lifting beam from above the object toward the object with a gap between the lower end surface and the object so that the lower end surface is not in contact with the object. The object has a recess in the outer surface, and a portion of the lower end surface is positioned in the recess when the object is connected to the lifting beam via the string member.

For connecting the object to the lifting beam via the string member, the lifting beam needs to be brought closer to the object than when the object is suspended from the lifting beam. The height of the lifting beam relative to the object in a state where the object is suspended from the lifting beam needs to be determined with a margin of distance at which the lifting beam approaches the object to connect the object to the lifting beam via the string member, so that the height of the lifting beam relative to the object is increased accordingly. However, with the above configuration (10), since the lifting beam can approach the object so that a portion of the lower end surface is positioned in the recess of the object when connecting the object to the lifting beam via the string member, it is possible to suppress an increase in height of the lifting beam relative to the object when the object is suspended from the lifting beam. As a result, it is possible to reduce the total lifting height, and it is possible to reduce the lifting cost.

(11) In some embodiments, in the above method (9) or (10), when the lifting beam is lifted, a center of gravity of the lifting beam and a center of gravity of the object are aligned on the same vertical line.

With the above configuration (11), it is possible to stably lift the object suspended from the lifting beam.

(12) In some embodiments, in any one of the above methods (9) to (11), the object is asymmetric in a longitudinal direction of the object.

With the above configuration (12), since the object asymmetric in the longitudinal direction and recessed between both ends can be suspended from the lifting beam while bringing the lifting beam as close to the object as possible, it is possible to reduce the total lifting height, and consequently, it is possible to reduce the lifting cost.

Advantageous Effects

According to at least one embodiment of the present invention, an object to be lifted can be suspended from a lifting beam while bringing the lifting beam as close to the object as possible, i.e., the suspension point can be lowered. Thus, it is possible to reduce the total lifting height, and consequently, it is possible to reduce the lifting cost.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

Figure 1:
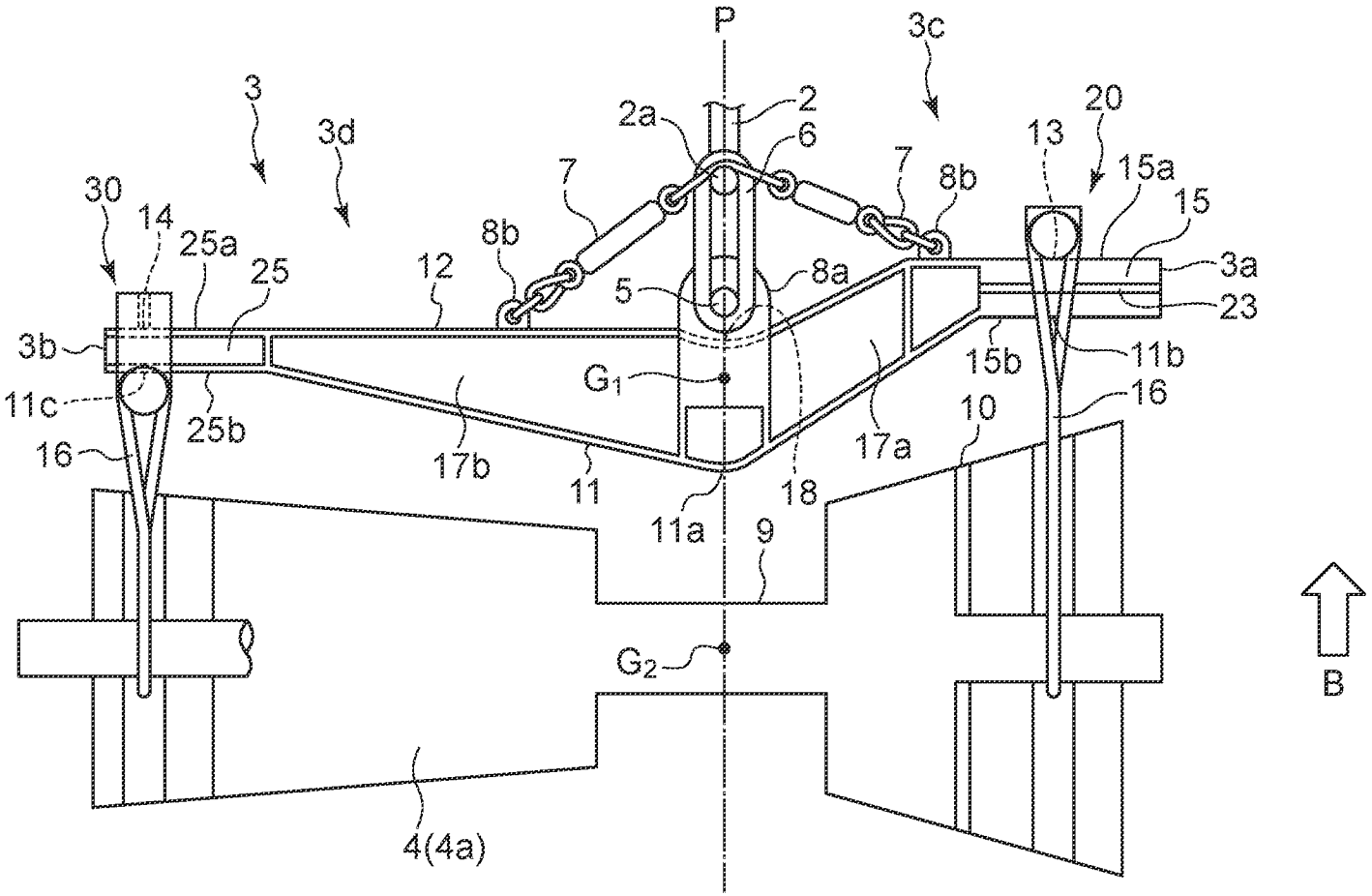
FIG. 1 is a diagram of a lifting beam suspended from an overhead crane according to an embodiment of the present invention.

FIG. 1 shows a lifting beam according to an embodiment of the present invention. A lifting beam 3 is suspended by a wire member 7 of a lifting device 2 mounted on a body of an overhead crane (not shown) so as to be vertically movable by the lifting device 2 of the overhead crane. The lifting beam 3 suspends a rotor 4*a* of a gas turbine via a string member, namely, a sling 16. Although in this embodiment, an object 4 to be lifted suspended from the overhead crane is the rotor 4*a* of the gas turbine, the object 4 is not limited to the rotor 4*a*.

The object 4 may be any object that has a relatively elongated shape. For example, the object may be a casing of a rotary machine or any plant equipment machine.

The lifting beam 3 has an upper end surface 12 extending along the longitudinal direction of the lifting beam 3 and positioned on the vertical upper side in a state where the rotor 4*a* is suspended. On the upper end surface 12, a bracket 8*a* including a pin 5 and two brackets 8*b*, 8*b* disposed on the opposite side to the bracket 8*a* are provided. The lifting beam 3 is connected to the lifting device 2 by engaging a hook 6 with the pin 5 and a pin 2*a* of the lifting device 2 and engaging both ends of the wire member 7 hooked to the pin 2*a* with the corresponding brackets 8*b*, 8*b*.

The lifting beam 3 also has a lower end surface 11 extending along the longitudinal direction of the lifting beam 3 and positioned on the vertical lower side in a state where the rotor 4*a* is suspended. A first lower end portion 11*a* in the lowest position on the lower end surface 11 is positioned such that, when the lifting beam 3 is divided into a first-side portion 3*c* with a first end 3*a* of the lifting beam 3 and a second-side portion 3*d* with a second end 3*b* of the lifting beam 3 by a reference plane P passing through the center of gravity $G_1$ of the lifting beam 3 and the first lower end portion 11*a* and perpendicular to the longitudinal direction of the lifting beam 3, a moment of the first-side portion 3*c* is equilibrated by a moment of the second-side portion 3*d*. This moment equilibrium prevents rotation of the lifting beam 3 that may occur when the lifting beam 3 is connected to the lifting device 2 without suspending the object 4.

To achieve the moment equilibrium, a side with the smaller moment, i.e., the first-side portion 3*c* in this embodiment, is provided with a first support portion 15 of rectangular block shape. By adjusting the size and the weight of the first support portion 15, the moment equilibrium can be achieved. Since a portion of the lifting beam 3 other than the first support portion 15 is composed of an H-shaped steel beam, the moment equilibrium can be adjusted by the first support portion 15 of relatively small volume.

The first support portion 15 and a second support portion 25 in the vicinities of both ends 3*a*, 3*b* of the lifting beam 3 each have a flat upper end surface 15*a*, 25*a* (the upper end surface 15*a*, 25*a* constitutes a part of the upper end surface 12) extending in the horizontal direction in a state where the lifting beam 3 is connected to the lifting device 2. Each upper end surface 15*a*, 25*a* is provided with a position adjustment member 20, 30 for adjusting a position at which the rotor 4*a* is suspended via the sling 16.

Figure 2:
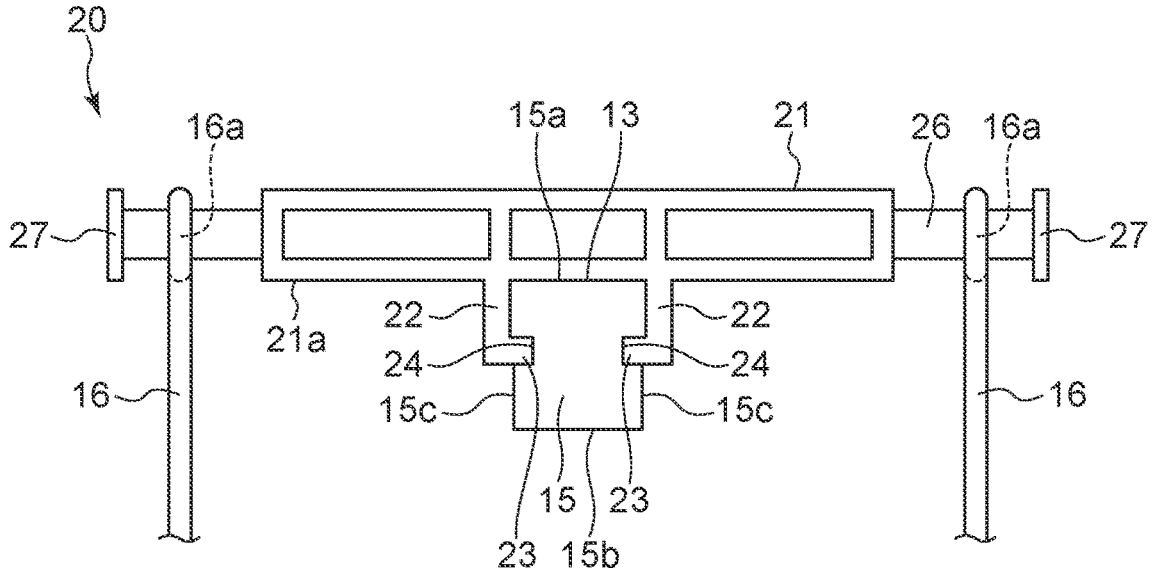
FIG. 2 is a front view of a position adjustment member disposed on a lifting beam according to an embodiment of the present invention.

As shown in FIG. 2, the position adjustment member 20 has a body 21 placed on the upper end surface 15*a* of the first support portion 15. The body 21 has a rectangular shape elongated in a direction perpendicular to the longitudinal direction of the first support portion 15 (in FIG. 2, a direction perpendicular to the plane of the figure). A lower surface 21*a* of the body 21 is provided with a pair of engagement members 22, 22 extending vertically downward, and the first support portion 15 is disposed between the pair of engagement members 22, 22. The lower ends of the engagement members 22 form engagement end portions 23 bent so as to face each other. Each engagement end portion 23 is inserted in a groove 24 formed on each side surface 15*c* of the first support portion 15 so as to extend in the longitudinal direction of the first support portion 15. By sliding the body 21 in the longitudinal direction of the first support portion 15 so as to move the engagement end portions 23 along the grooves 24, the position adjustment member 20 is slid along the first support portion 15. Since the body 21 is held by the grooves 24 and portions of the side surfaces 15*c* of the first support portion 15 in contact with the engagement members 22, the body 21 is prevented from rotating.

Figure 3:
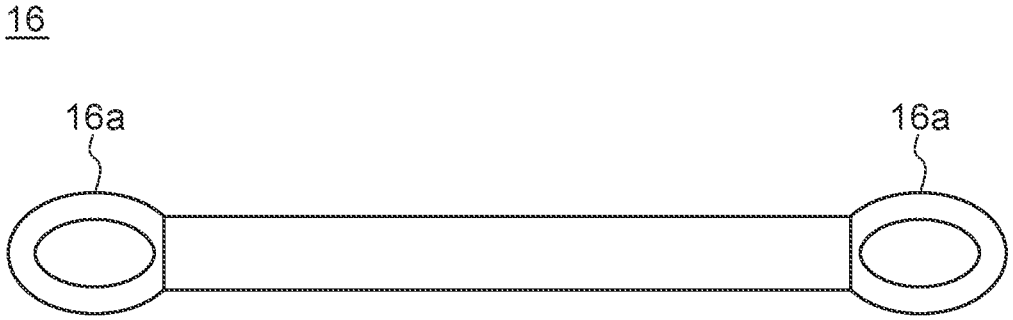
FIG. 3 is a plan view of a sling according to an embodiment of the present invention.

The body 21 has a rod member 26 passing through the body 21 in the longitudinal direction. Each end of the rod member 26 has a disc-shaped end plate 27 having a larger diameter than the outer diameter of the rod member 26. The rod member 26 is engaged with both ends of the sling 16 between the body 21 and each end plate 27. As shown in FIG. 3, the sling 16 is a string member made of fiber having engagement portions 16*a* of loop shape at both ends. Referring to FIG. 2 again, by inserting the rod member 26 into the loop-shaped engagement portions 16*a* at both ends of the sling 16 and engaging the engagement portions 16*a* with the rod member 26, the sling 16 for suspending the rotor 4*a* (see FIG. 1) can be attached to the position adjustment member 20.

When the rotor 4*a* is suspended from the lifting beam 3 via the sling 16, the rotor 4*a* is suspended and supported at a portion on the upper end surface 15*a* of the first support portion 15 on which the body 21 is placed. This portion is defined as a first support point 13. By sliding the position adjustment member 20 along the first support portion 15, the position of the first support point 13 can be adjusted.

Figure 4:
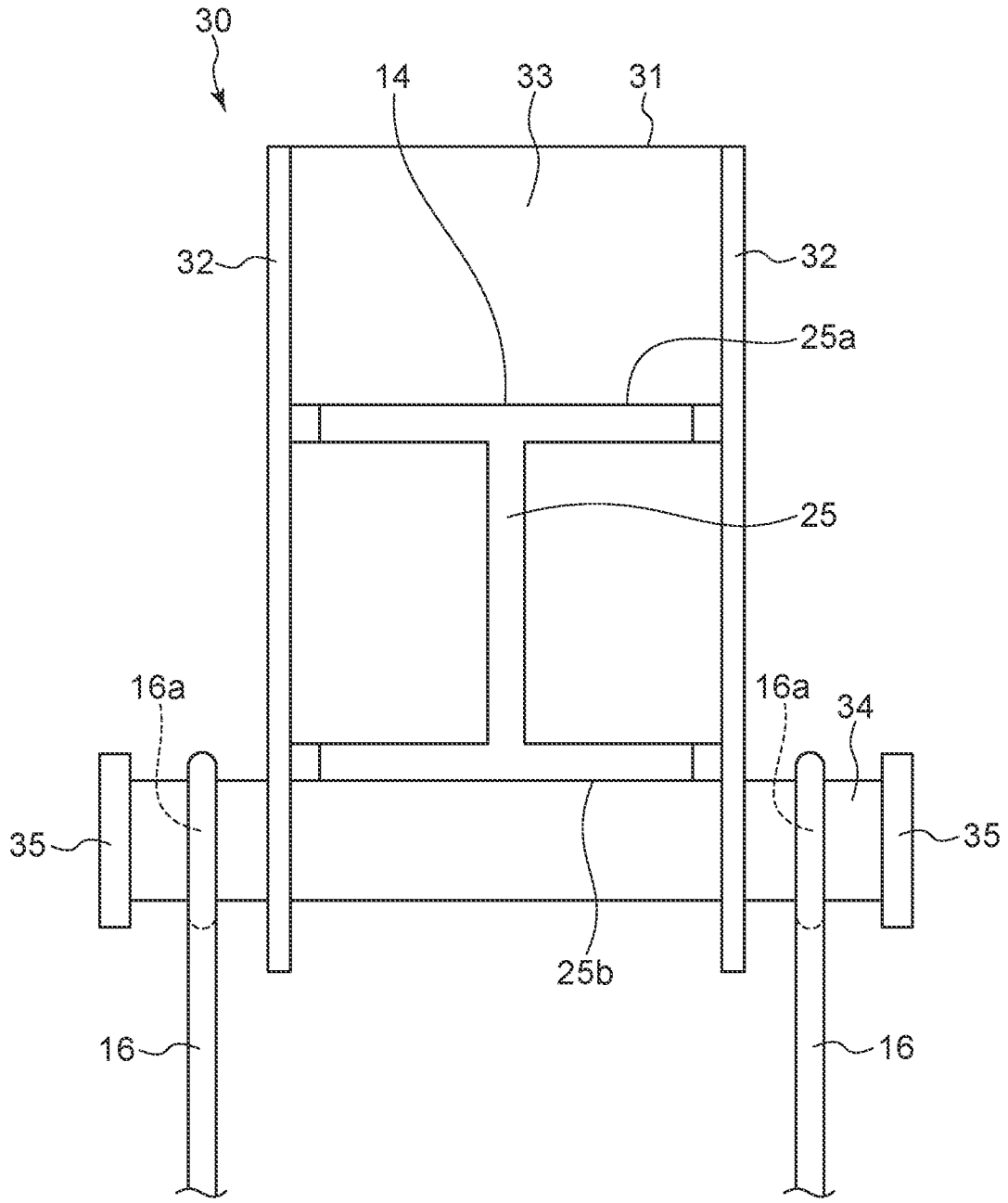
FIG. 4 is a front view of a position adjustment member disposed on a lifting beam according to an embodiment of the present invention.

As shown in FIG. 4, the position adjustment member 30 has a body 31. The body 31 has a pair of side surface portions 32, 32 sandwiching the lifting beam 3 from the horizontal direction and an engagement portion 33, fixed between the pair of side surface portions 32, 32 and placed on the upper end surface 25*a* of the second support portion 25, for engaging the body 31 with the second support portion 25. By changing the position of the engagement portion 33 placed on the upper end surface 25*a*, the position adjustment member 30 is slid along the second support portion 25.

The body 31 has a rod member 34 passing through the pair of side surface portions 32, 32 and adjacent to the lower end surface 25*b* of the second support portion 25 (the lower end surface 25*b* constitutes a part of the lower end surface 11). Each end of the rod member 34 has a disc-shaped end plate 35 having a larger diameter than the outer diameter of the rod member 34. By engaging the engagement portions 16*a* of the sling 16 with the rod member 34 between each side surface portion 32 and each end plate 35, the sling 16 for suspending the rotor 4*a* (see FIG. 1) can be attached to the position adjustment member 30.

When the rotor 4*a* is suspended from the lifting beam 3 via the sling 16, the rotor 4*a* is suspended and supported at a portion on the upper end surface 25*a* of the second support portion 25 on which the engagement portion 33 is placed. This portion is defined as a second support point 14. By sliding the position adjustment member 30 along the second support portion 25, the position of the second support point 14 can be adjusted.

As shown in FIG. 1, a portion on the lower end surface 15*b* (the lower end surface 15*b* constitutes a part of the lower end surface 11) of the first support portion 15 coinciding in the longitudinal direction of the lifting beam 3 with the first support point 13 for suspending and supporting the rotor 4*a* is referred to as a second lower end portion 11*b*. In other words, the first support point 13 can also be referred to as a second upper end portion in the same position as the second lower end portion 11*b* in the longitudinal direction of the lifting beam 3. The first upper end portion 18 located in the same position as the first lower end portion 11*a* in the longitudinal direction of the lifting beam 3 is positioned lower than the second upper end portion (first support point 13) in the vertical direction. Further, a portion on the lower end surface 25*b* of the second support portion 25 coinciding in the longitudinal direction of the lifting beam 3 with the second support point 14 for suspending and supporting the rotor 4*a* is referred to as a third lower end portion 11*c*. The second lower end portion 11*b* is higher than the first lower end portion 11*a*, the third lower end portion 11*c* is lower than the second lower end portion 11*b*, and the second lower end portion 11*b* is higher than the first lower end portion 11*a*. When the lifting beam 3 has the first lower end portion 11*a*, the second lower end portion 11*b*, and the third lower end portion 11*c* with different heights, the lifting beam 3 can suspend an object 4 whose height is locally high in the longitudinal direction while coming as close to the object 4 as possible, i.e., the suspension point can be lowered. Thus, it is possible to reduce the total lifting height, and consequently, it is possible to reduce the lifting cost.

The lifting beam 3 has a first tapered portion 17*a* disposed between the first lower end portion 11*a* and the second lower end portion 11*b* and decreasing in height from the first lower end portion 11*a* toward the second lower end portion 11*b*, and a second tapered portion 17*b* disposed between the first lower end portion 11*a* and the third lower end portion 11*c* and decreasing in height from the first lower end portion 11*a* toward the third lower end portion 11*c*. When the rotor 4*a* is suspended and supported at the first support point 13 and the second support point 14, the moment applied to the first tapered portion 17*a* and the moment applied to the second tapered portion 17*b* increase with an increase in distance from the first support point 13 and the second support point 14 respectively, i.e., as approaching the first lower end portion 11*a*. Accordingly, in the vicinity of the first lower end portion 11*a*, the height needs to be increased to achieve stiffness that can withstand a large moment. On the other hand, since the moment decreases with an increase in distance from the first lower end portion 11*a*, i.e., as approaching each end 3*a*, 3*b* of the lifting beam 3, the height can be reduced in this direction. With the lifting beam 3 having this configuration, it is possible to reduce the weight of the lifting beam 3 compared to the case where the height in the longitudinal direction is constant. Since a larger lifting weight requires a larger crane and thus a higher cost, it is possible to reduce the lifting cost by reducing the weight of the lifting beam.

In this embodiment, the rotor 4*a* has a recess 9 positioned vertically below the first lower end portion 11*a* when the rotor 4*a* is suspended from the lifting beam 3 via the sling 16, and the first lower end portion 11*a* of the lifting beam 3 and its peripheral portion can be inserted in the recess 9. In this embodiment, the center of gravity $G_1$ of the lifting beam 3, the center of gravity $G_2$ of the rotor 4*a*, and the hook 6 are aligned on the same vertical line. Thus, it is possible to stably lift the rotor 4*a* suspended from the lifting beam 3.

Next, a method for lifting an object suspended from an overhead crane including the lifting beam according to an embodiment of the present invention will be described.

Figure 5:
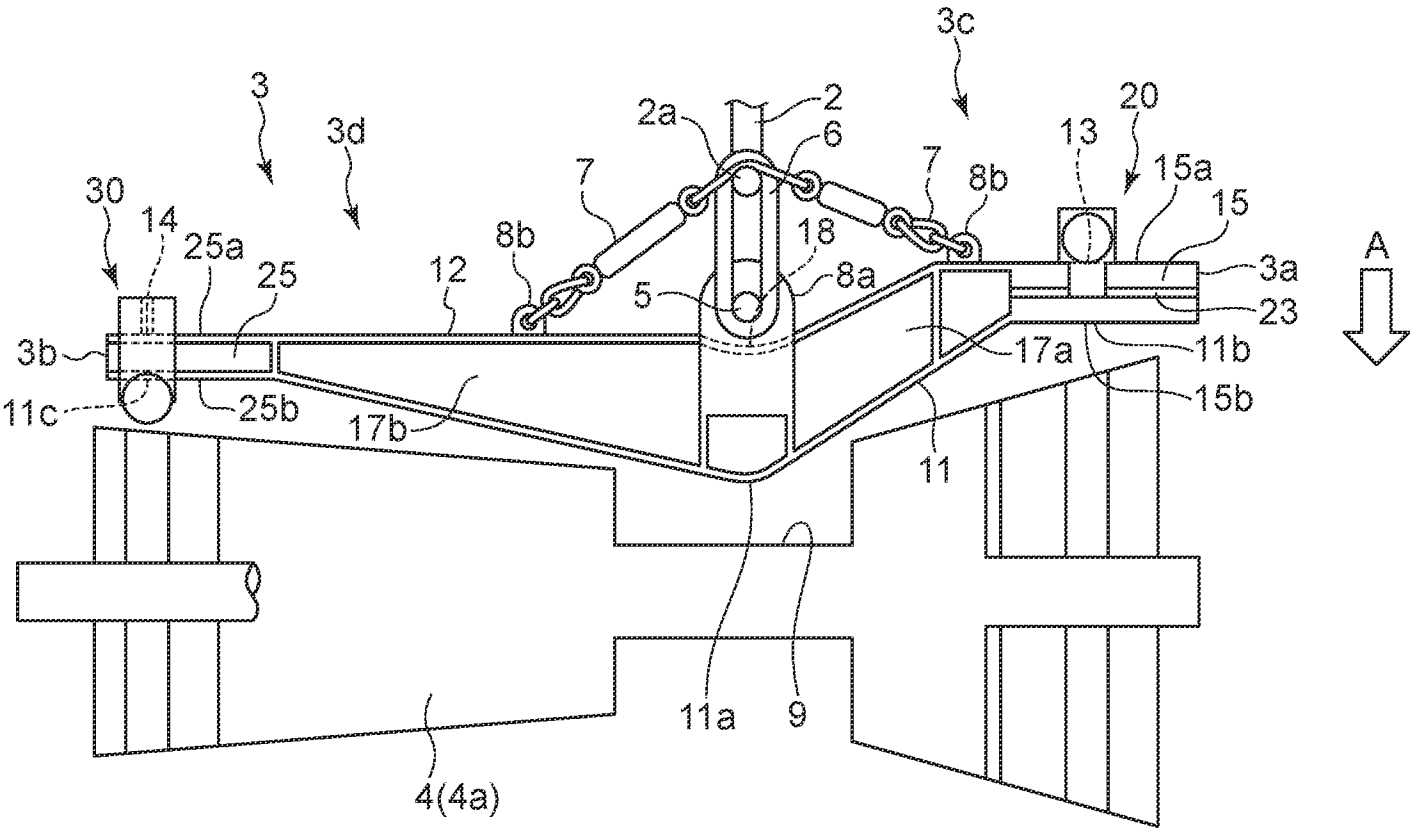
FIG. 5 is a diagram for describing a step of a method for lifting an object to be lifted according to an embodiment of the present invention.

As shown in FIG. 5, the lifting device 2 lowers the lifting beam 3 toward the rotor 4*a* from above the rotor 4*a* (arrow A). The lifting beam 3 is lowered with a gap between the lower end surface 11 and the rotor 4*a* so that the lower end surface 11 is not in contact with the rotor 4*a*. When the lowering of the lifting beam 3 is completed, the first lower end portion 11*a* and its peripheral portion are positioned inside the recess 9.

Figure 6A:
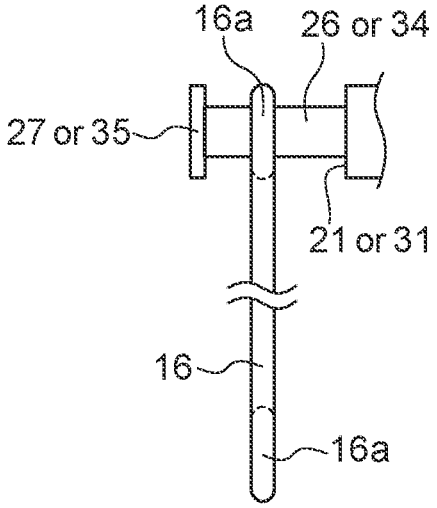
FIG. 6A is a diagram for describing procedure for connecting a rotor to a lifting beam via a sling in a method for lifting an object to be lifted according to an embodiment of the present invention.
Figure 6B:
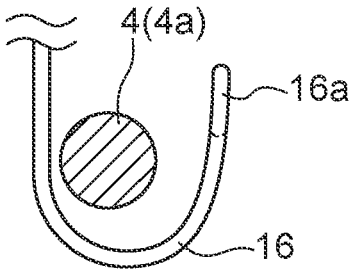
FIG. 6B is a diagram for describing procedure for connecting a rotor to a lifting beam via a sling in a method for lifting an object to be lifted according to an embodiment of the present invention.
Figure 6C:
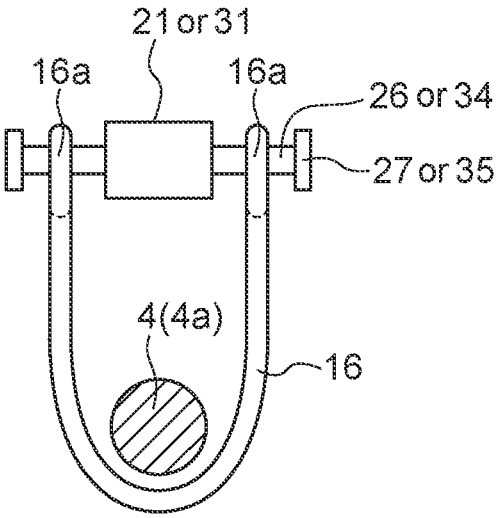
FIG. 6C is a diagram for describing procedure for connecting a rotor to a lifting beam via a sling in a method for lifting an object to be lifted according to an embodiment of the present invention.

As shown in FIG. 6A, one of the engagement portions 16*a* of one sling 16 is engaged with the rod member 26 between the body 21 and one of the end plates 27. Further, one of the engagement portions 16*a* of the other sling 16 is engaged with the rod member 34 between the body 31 and one of the end plates 35. Then, as shown in FIG. 6B, the other engagement portion 16*a* of each sling 16 is passed below the rotor 4*a*. Then, as shown in FIG. 6C, the other engagement portion 16*a* of the one sling 16 is engaged with the rod member 26 between the body 21 and the other end plate 27. Further, the other engagement portion 16*a* of the other sling 16 is engaged with the rod member 34 between the body 31 and the other end plate 35 (see FIG. 3).

As shown in FIG. 5, since the first lower end portion 11*a* is positioned inside the recess 9 when connecting the rotor 4*a* to the lifting beam 3 via the sling 16, the lifting beam 3 is closer to the rotor 4*a* in the state of FIG. 5 than in the state of FIG. 1 where the rotor 4*a* is suspended from the lifting beam 3. Thus, as shown in FIGS. 6B and 6C, the other engagement portion 16*a* of each sling 16 can be passed below the rotor 4*a* to engage with the rod member 26, 34, with the sling 16 loosened, which facilitates connection between the rotor 4*a* and the lifting beam 3 via the sling 16.

Further, for connecting the rotor 4*a* to the lifting beam 3 via the sling 16, the lifting beam 3 needs to be brought closer to the rotor 4*a* than when the rotor 4*a* is suspended from the lifting beam 3. The height of the lifting beam 3 relative to the rotor 4*a* in a state where the rotor 4*a* is suspended from the lifting beam 3 needs to be determined with a margin of distance at which the lifting beam 3 approaches the rotor 4*a* to connect the rotor 4*a* to the lifting beam 3 via the sling 16, so that the height of the lifting beam 3 relative to the rotor 4*a* is increased accordingly. However, in this embodiment, since the lifting beam 3 can approach the rotor 4*a* so that the first lower end portion 11*a* is positioned in the recess 9 of the rotor 4*a* when connecting the rotor 4*a* to the lifting beam 3 via the sling 16, it is possible to suppress an increase in height of the lifting beam 3 relative to the rotor 4*a* when the rotor 4*a* is suspended from the lifting beam 3. As a result, it is possible to reduce the total lifting height, and it is possible to reduce the lifting cost.

Then, as shown in FIG. 1, the lifting device 2 lifts the lifting beam 3 (arrow B). When the lifting beam 3 is lifted, the loosened sling 16 is tensioned. Further, as the lifting beam 3 is lifted, the rotor 4*a* suspended from the lifting beam 3 is lifted. When the rotor 4*a* is suspended from the lifting beam 3, the first lower end portion 11*a* is positioned lower than the highest portion 10 of the outer surface of the rotor 4*a*. This enables the rotor 4*a* to be suspended from the lifting beam 3 while the lifting beam 3 is brought as close to the rotor 4*a* as possible. Thus, it is possible to reduce the total lifting height compared to the lifting beam having a uniform linear shape in the longitudinal direction, and consequently, it is possible to reduce the lifting cost.

As described above, the rotor 4*a* can be suspended from the lifting beam 3 while bringing the lifting beam 3 as close to the rotor 4*a* as possible, i.e., the suspension point can be lowered, and thus it is possible to reduce the total lifting height, and consequently, it is possible to reduce the lifting cost.

Figure 7:
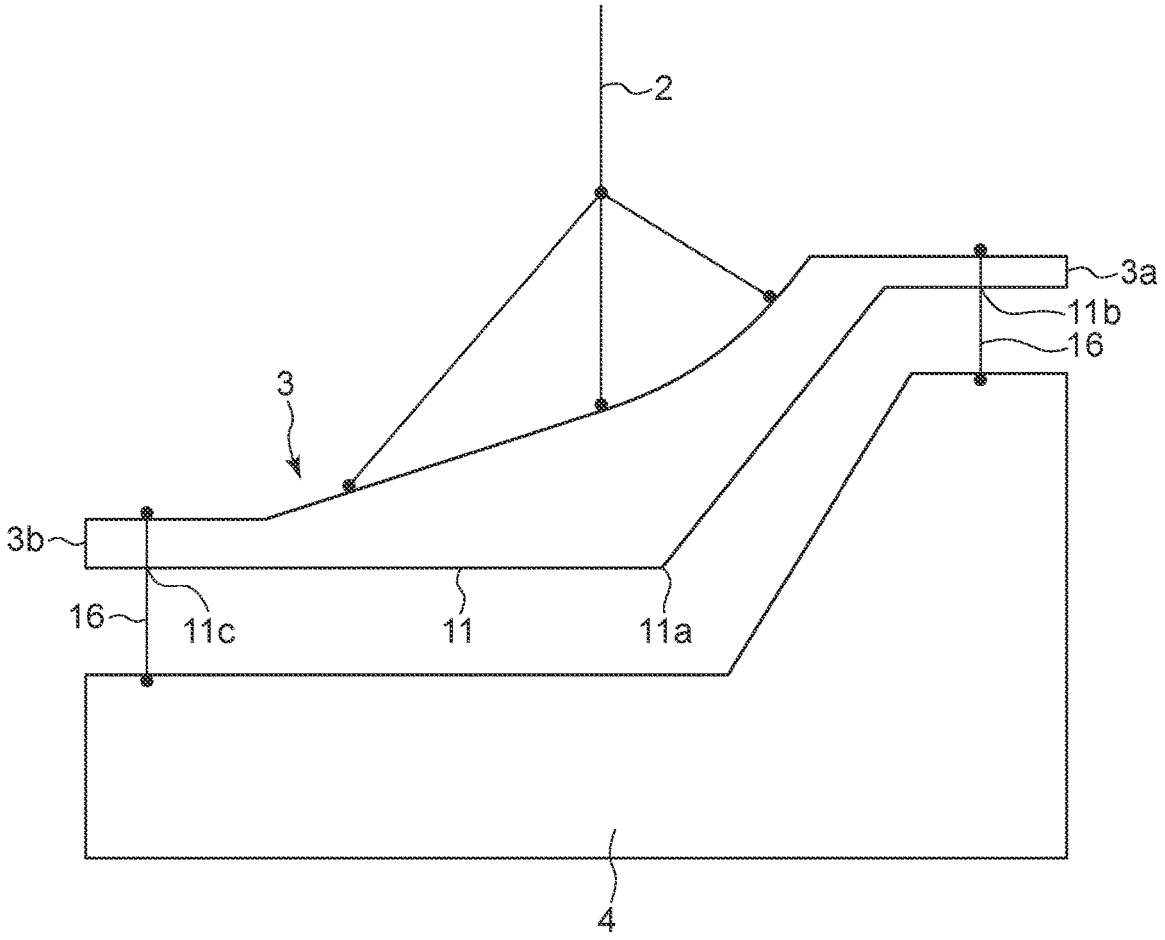
FIG. 7 is a schematic view of a modification of a lifting beam according to an embodiment of the present invention.

Although in this embodiment, the first lower end portion 11*a* of the lifting beam 3 is below both the second lower end portion 11*b* and the third lower end portion 11*c*, the present invention is not limited to this embodiment. The first lower end portion 11*a* may be in any position between the second lower end portion 11*b* and the third lower end portion 11*c*, and may be positioned higher than the third lower end portion 11*c*. Further, for instance as shown in FIG. 7, the first lower end portion 11*a* and the third lower end portion 11*c* may be in the same position in the vertical direction, and the second lower end portion 11*b* may be positioned higher than the first lower end portion 11*a* and the third lower end portion 11*c*. Further, although the first lower end portion 11*a* is positioned such that, when the lifting beam 3 is divided into the first-side portion 3*c* with the first end 3*a* of the lifting beam 3 and the second-side portion 3*d* with the second end 3*b* of the lifting beam 3 by the reference plane P passing through the center of gravity $G_1$ of the lifting beam 3 and the first lower end portion 11*a* and perpendicular to the longitudinal direction of the lifting beam 3, a moment of the first-side portion 3*c* is equilibrated by a moment of the second-side portion 3*d*, the first lower end portion 11*a* may be displaced from this position.

Figure 8:
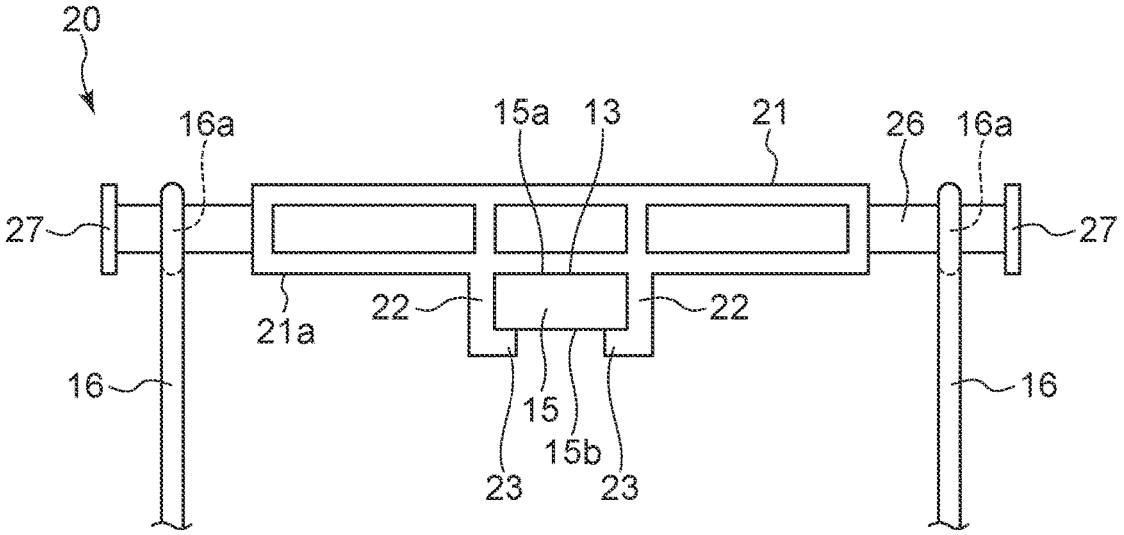
FIG. 8 is a front view of a modification of a position adjustment member disposed on a lifting beam according to an embodiment of the present invention.

Although in this embodiment, as shown in FIG. 2, the first support portion 15 has the groove 24 in each side surface 15*c* so as to extend in the longitudinal direction of the first support portion 15, the present invention is not limited to this embodiment. The shape of the first support portion 15 shown in FIG. 2 is intended to maintain the position of the center of gravity when the lifting beam 3 is lifted alone near the suspension point, and the structure of the groove 24 (e.g., depth and width of groove) can be freely changed so as to have a weight necessary for adjusting the position of the center of gravity. For instance, when it is intended to shift the center of gravity toward the first end 3*a*, the groove is changed (e.g., depth and width of groove are decreased) so as to increase the weight of the first support portion 15. Further, the shape of the first support portion 15 can also be freely changed for the same purpose. For instance, as shown in FIG. 8, the first support portion 15 may have a simple rectangular shape, and the engagement end portions 23 may be engaged with the lower end surface 15*b* of the first support portion 15.

Although in this embodiment, the sling 16 made of fiber is used as the string member for suspending the rotor 4*a* to the lifting beam 3, the present invention is not limited thereto. The string member may be a metallic wire or chain that has a sufficient strength for suspending the rotor 4*a*. Further, although in this embodiment, the engagement portions 16*a* at both ends of the sling 16 are engaged with the lifting beam 3, and the rotor 4*a* is suspended and supported from below between the ends of the sling 16, the present invention is not limited to this embodiment. For instance, the rotor 4*a* may be suspended by connecting one end of the string member to the lifting beam 3 by any means and connecting the other end of the string member to the rotor 4*a* by any means.

Although in this embodiment, each of the positions of the first support point 13 and the second support point 14, i.e., the positions of the second lower end portion 11*b* and the third lower end portion 11*c* are adjustable, only either one may be adjustable. That is, the position of the other one may be fixed. Further, the configurations of the position adjustment members 20, 30 are not limited to that described in this embodiment, and the position adjustment members 20, 30 may have any configuration. Two position adjustment members 20 may be used by using the position adjustment member 20 instead of the position adjustment member 30, or two position adjustment members 30 may be used by using the position adjustment member 30 instead of the position adjustment member 20.

Although in this embodiment, the object 4 is shaped such that a high-height portion is formed in a portion of the longitudinal direction, the object 4 may be asymmetric in the longitudinal direction as with the rotor 4*a*.

REFERENCE SIGNS LIST

2 Crane
3 Lifting beam
3*a* End (of lifting beam)
3*b* End (of lifting beam)
3*c* First-side portion (of lifting beam)
3*d* Second-side portion (of lifting beam)
4 Object
4*a* Rotor
5 Pin
6 Hook
7 Wire
8*a* Bracket
8*b* Bracket
9 Recess
10 Highest portion
11 Lower end surface
11*a* First lower end portion
11*b* Second lower end portion
11*c* Third lower end portion
12 Upper end surface
13 First support point (Second upper end portion)
14 Second support point
15 First support portion
15*a* Upper end surface (of first support portion)
15*b* Lower end surface (of first support portion)
15*c* Side surface (of first support portion)
16 Sling (String member)
16*a* Engagement portion
17*a* First tapered portion
17*b* Second tapered portion
18 First upper end portion
20 Position adjustment member
21 Body
21*a* Lower surface (of body)
22 Engagement member
23 Engagement end portion
24 Groove
25 Second support portion
25*a* Upper end surface (of second support portion)
25*b* Lower end surface (of second support portion)
26 Rod member
27 End plate
30 Position adjustment member
31 Body
32 Side surface portion
33 Engagement portion
34 Rod member 35 End plate
$G_1$ Center of gravity (of lifting beam)
$G_2$ Center of gravity (of rotor)
P Reference plane

The invention claimed is:

1. A lifting beam for suspending an object to be lifted in a vertical direction, comprising a lower end surface extending in a longitudinal direction of the lifting beam and positioned on a vertical lower side in a state where the object is suspended, the lower end surface including:

a first lower end portion;

a second lower end portion positioned away from the first lower end portion to a first side in the longitudinal direction; and a third lower end portion positioned away from the first lower end portion to a second side in the longitudinal direction, on an opposite side of the first lower end portion from the second lower end portion, wherein the second lower end portion is positioned higher than the first lower end portion, and the third lower end portion is positioned lower than the second lower end portion, in a state where the object is suspended from the lifting beam, wherein the second lower end portion is located in the same position as a first support point for suspending and supporting the object in the longitudinal direction, and wherein the third lower end portion is located in the same position as a second support point for suspending and supporting the object in the longitudinal direction.

2. The lifting beam according to claim 1, comprising an upper end surface extending in the longitudinal direction of the lifting beam and positioned on a vertical upper side in a state where the object is suspended, the upper end surface including:

a first upper end portion located in the same position as the first lower end portion in the longitudinal direction; and a second upper end portion located in the same position as the second lower portion in the longitudinal direction, wherein the first upper end portion is positioned lower than the second upper end portion in the vertical direction.

3. The lifting beam according to claim 1, wherein the first lower end portion is positioned lower than the third lower end portion.

4. The lifting beam according to claim 1, wherein the first lower end portion is positioned such that a moment of a first-side portion of the lifting beam is equilibrated by a moment of a second-side portion of the lifting beam when the lifting beam is divided into the first-side portion including the second lower end portion and the second-side portion including the third lower end portion by a reference plane passing through a center of gravity of the lifting beam and the first lower end portion and perpendicular to the longitudinal direction.

5. The lifting beam according to claim 4, comprising:

a first tapered portion disposed between the first lower end portion and the second lower end portion and decreasing in height from the first lower end portion toward the second lower end portion; and a second tapered portion disposed between the first lower end portion and the third lower end portion and decreasing in height from the first lower end portion toward the third lower end portion.

6. The lifting beam according to claim 5, comprising:

a first support portion extending from an end of the first tapered portion along the longitudinal direction and having a lower end surface including the second lower end portion; and a second support portion extending from an end of the second tapered portion along the longitudinal direction and having a lower end surface including the third lower end portion, and wherein at least one of a first support point and a second support point for suspending and supporting the object is adjustable in position in the longitudinal direction.

7. The lifting beam according to claim 6, comprising an upper end surface extending in the longitudinal direction of the lifting beam and positioned on a vertical upper side in a state where the object is suspended, wherein at least one of a position adjustment member for adjusting a suspended position of the object at the first support point or a position adjustment member for adjusting a suspended position of the object at the second support point is arrangeable on the upper end surface.

8. A method for lifting an object to be lifted suspended from a lifting beam in a vertical direction, the lifting beam comprising a lower end surface extending in a longitudinal direction of the lifting beam and positioned on a vertical lower side in a state where the object is suspended, the lower end surface including:

a first lower end portion;

a second lower end portion positioned away from the first lower end portion to a first side in the longitudinal direction; and a third lower end portion positioned away from the first lower end portion to a second side in the longitudinal direction, on an opposite side of the first lower end portion from the second lower end portion, wherein the second lower end portion is positioned higher than the first lower end portion, and the third lower end portion is positioned lower than the second lower end portion in a state where the object is suspended from the lifting beam, wherein the second lower end portion is located in the same position as a first support point for suspending and supporting the object in the longitudinal direction, and wherein the third lower end portion is located in the same position as a second support point for suspending and supporting the object in the longitudinal direction, the object having an outer surface, the outer surface including a portion that is highest in the vertical direction in a state where the object is suspended from the lifting beam, in the state where the object is suspended from the lifting beam, the lower end surface being positioned higher than the object in the vertical direction such that the lower end surface is apart from the object, the method comprising a connection step of connecting the object to the lifting beam via a string member, wherein, in the connection step, only a portion of the lower end surface is positioned lower than the portion of the outer surface of the object.

9. The method according to claim 8, further comprising, before the connection step, a step of lowering the lifting beam from above the object toward the object with a gap between the lower end surface and the object so that the lower end surface is not in contact with the object, wherein the object has a recess in the outer surface, and a portion of the lower end surface is positioned in the recess when the object is connected to the lifting beam via the string member.

10. The method according to claim 8, wherein, when the lifting beam is lifted, a center of gravity of the lifting beam and a center of gravity of the object are aligned on the same vertical line.

11. The method according to claim 8, wherein the object is asymmetric in a longitudinal direction of the object.

* * * * *